US007281913B2

(12) United States Patent
Oiwake

(10) Patent No.: US 7,281,913 B2
(45) Date of Patent: Oct. 16, 2007

(54) COMPRESSOR INCLUDING INTEGRALLY FORMED SEPARATION TUBE AND SEAL BOLT

(75) Inventor: Yuuji Oiwake, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 11/340,516

(22) Filed: Jan. 27, 2006

(65) Prior Publication Data

US 2006/0171832 A1 Aug. 3, 2006

(30) Foreign Application Priority Data

Jan. 28, 2005 (JP) ..... 2005-021652

(51) Int. Cl.
*F03C 2/00* (2006.01)
*F04C 18/00* (2006.01)

(52) U.S. Cl. ..... 418/55.6; 418/55.1; 418/97; 418/270; 418/DIG. 1; 55/394; 55/396; 55/423

(58) Field of Classification Search ..... 418/55.1–55.6, 418/57, 97, 270, DIG. 1; 55/423, 467, 459.1, 55/394, 396
See application file for complete search history.

(56) References Cited

U.S. PATENT DOCUMENTS 5,669,154 A * 9/1997 Bellomo ..... 96/134
5,733,107 A 3/1998 Ikeda et al.
6,152,713 A * 11/2000 Hisanaga et al. ..... 418/55.6
2002/0134101 A1 9/2002 Gennami et al.
2005/0129536 A1* 6/2005 Ohtake ..... 418/55.6

FOREIGN PATENT DOCUMENTS

| | | | |
|---|---|---|---|
| EP | 19990899460 | | 3/1999 |
| EP | 20041475541 | | 10/2004 |
| JP | 2000170681 A | * | 6/2000 |
| JP | 2001295767 | | 10/2001 |
| JP | 2004278344 A | * | 10/2004 |
| JP | 2005264828 | | 9/2005 |

OTHER PUBLICATIONS

European Search Report for European Patent Appl'n. No. 06 00 1446, completed on Mar. 30, 2006.

* cited by examiner

*Primary Examiner*—Theresa Trieu
(74) *Attorney, Agent, or Firm*—Baker Botts L.L.P.

(57) ABSTRACT

A compressor includes an insertion hole which is formed separately from a discharge port in order to insert a separation tube for separating lubricating oil from compressed working fluid into a separation chamber, and a seal bolt which is screwed into the insertion hole to close the insertion hole, wherein the seal bolt and the separation tube are formed integrally with each other, and when the insertion hole is closed by the seal bolt, a flow path through which the separation tube and the discharge port communicate with each other is formed in the seal bolt.

1 Claim, 3 Drawing Sheets

COMPRESSOR INCLUDING INTEGRALLY FORMED SEPARATION TUBE AND SEAL BOLT

BACKGROUND OF THE INVENTION

1. Field of the Invention

The present invention relates to a compressor including an oil separator for separating a lubricating oil contained in a working fluid.

2. Description of the Related Art

A compressor of this type is used, for example, in a refrigeration circuit of an air conditioner for a vehicle. The compressor used in the refrigeration circuit includes a compression unit in its housing. The compression unit sucks therein a cooling medium as a working fluid and compresses the cooling medium sucked therein. The cooling medium thus compressed is fed from a discharge port provided in the housing toward a condenser of the refrigeration circuit and circulates in the refrigeration circuit.

In general, the cooling medium in the refrigeration circuit contains a lubricating oil. The lubricating oil lubricates a sliding surface, a bearing and the like within the compressor, and is also useful for sealing the sliding surface within the compressor. However, since a large amount of lubricating oil in the cooling medium causes reduction in cooling ability of the refrigeration circuit, an oil separator is incorporated in the compressor of this type. After having guided the cooling medium compressed by the compression unit to separate a part of the lubricating oil from the cooling medium, the oil separator guides the cooling medium toward the discharge port.

More specifically, the oil separator includes a cylindrical separation chamber having an introduction port in its inner peripheral surface. A separation tube is disposed concentrically within the separation chamber. The cooling medium which is introduced into the separation chamber through the introduction port after having been compressed by the compression unit revolves and flows helically around the separation tube along the inner peripheral wall of the separation chamber. In this process, a part of the lubricating oil contained in the cooling medium is centrifuged to be separated from the cooling medium. The cooling medium which has been subjected to the separation processing is fed toward the discharge port through the separation tube, while the separated lubricating oil is discharged from the separation chamber to an oil storage chamber to be stored in the oil storage chamber.

In the case where the compressor has the above-mentioned oil separator built therein, it can cause the cooling medium in which the amount of lubricating oil is moderately reduced to circulate in the refrigeration circuit. As a result, it is possible to avoid the reduction in cooling ability due to an excessive amount of lubricating oil.

In the compressor including the oil separator as described above, an insertion hole is formed in the housing for the purpose of disposing the separation tube within the separation chamber. The separation tube is inserted through the insertion hole to be attached to the separation chamber, and fixed to the housing with a snap ring or the like. Thereafter, a seal bolt is screwed into the insertion hole to close the insertion hole, thereby preventing the cooling medium from leaking from the insertion hole.

For this reason, the performance of the compressor is enhanced from the attachment of the oil separator. However, the parts such a the separation tube, the snap ring and the seal bolt are added to increase the number of assembly processes. As a result, such configuration involves a problem that the part cost and the assembly cost increase.

As one of measures for solving such a problem, Japanese Unexamined Patent Publication No. 2001-295767 (hereinafter referred to as Patent Document 1) proposes a compressor in which a separation tube and a discharge port are integrated with each other so that the separation tube can be disposed in a separation chamber without providing an insertion port.

In the case of an oil separator disclosed in Patent Document 1, since a discharge port is formed in one end of the separation tube, assembly of the oil separator is completed by only attachment of the separation tube to the separation chamber.

However, in the case of the compressor disclosed in Patent Document 1 described above, the discharge port is disposed coaxially with the separation tube, and the separation tube is pressed against the housing side through a distal end portion of a cooling medium pipe to be fixed thereto. For this reason, the position of the discharge port is limited to an axial direction of the separation chamber. As a result, there is a program that the degree of freedom of disposition of the discharge port is limited, and moreover the installation place and direction of the compressor are limited.

SUMMARY OF THE INVENTION

An aspect of the present invention is a compressor, comprising: a compression unit disposed within a housing for compressing a working fluid containing a lubricating oil; and an oil separator for feeding the working fluid toward a discharge port provided in the housing after separating a part of the lubricating oil from the working fluid compressed by the compression unit, the oil separator having a cylindrical separation chamber into which the working fluid is introduced, and a separation tube provided within the separation chamber for introducing the working gas introduced into the separation chamber toward the discharge port through its inside; wherein an insertion hole through which the separation tube is inserted into the separation chamber is formed in the housing separately from the discharge port, and the insertion hole is closed by a seal bolt screwed into the insertion hole; wherein the seal bolt and the separation tube are formed integrally with each other, and when the insertion hole is closed by the seal bolt, a flow path through which the separation tube and the discharge port communicate with each other is formed in the seal bolt.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETALED DESCRIPTION OF THE PREFERRED EMBODIMENTS

An embodiment of the present invention will hereinafter be described with reference to FIGS. 1 to 4.

Figure 1:
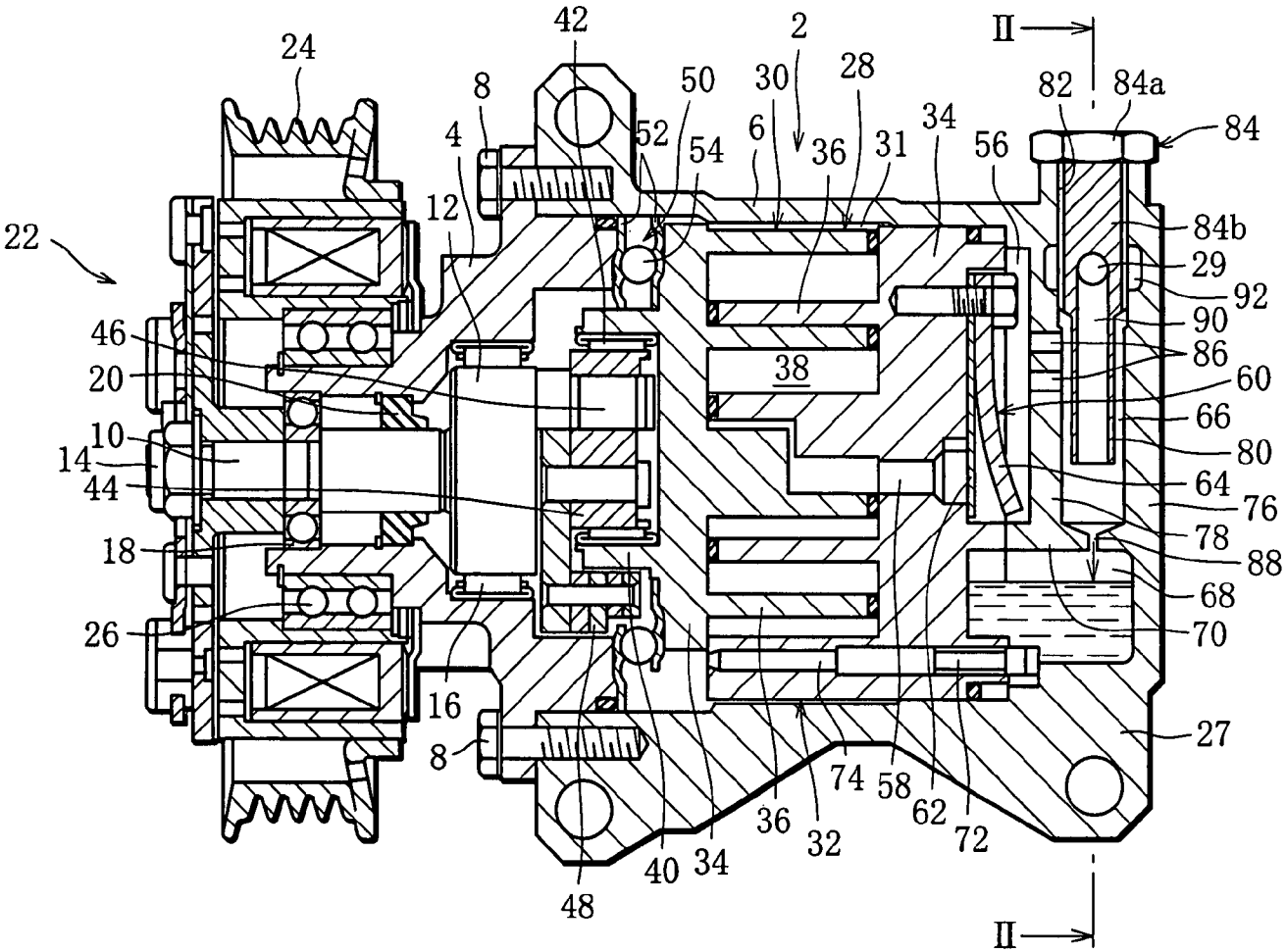
FIG. 1 is a vertical cross sectional view of a scroll type compressor according to an embodiment of the present invention.

FIG. 1 shows a scroll type compressor which is incorporated in a refrigeration circuit of an air conditioner for a vehicle. This compressor is used to compress a cooling medium (working fluid) of the refrigeration circuit. Here, the cooling medium contains a refrigerating machine oil as a lubricating oil. The refrigerating machine oil is supplied together with the cooling medium to a bearing and various kinds of sliding surfaces within the compressor. The refrigerating machine oil not only lubricates these constituent parts, but also exhibits a function of sealing the sliding surface.

The compressor includes a housing 2 which is comprised of a driving casing 4 and a compression casing 6. These casings 4 and 6 are connected to each other with a plurality of connection bolts 8. It should be noted that the compressor is installed within a vehicle room so that a vertical direction of FIG. 1 nearly coincides with a vertical direction of the vehicle since as will be described later, the lubricating oil is stored in a bottom portion of the compression casing 6.

A driving shaft 10 is disposed within the driving casing 4. The driving shaft 10 has a large-diameter end portion 12 on the compression casing 6 side. A small-diameter shaft portion 14 extends from the large-diameter end portion 12. The large-diameter end portion 12 is rotatably supported by the driving casing 4 through a needle bearing 16. The small-diameter shaft portion 14 is rotatably supported by the driving casing 4 through a ball bearing 18. Moreover, the small-diameter shaft portion 14 has a lip type seal 20 mounted between the ball bearing 18 and the large-diameter end portion 12. The lip type seal 20 relatively slidingly contact with the small-diameter shaft portion 14 to air-tightly partition the inside of the driving casing 4.

The small-diameter shaft portion 14 of the driving shaft 10 projects outward from the driving casing 4. A driving pulley 24 having an electromagnetic clutch 22 built therein is mounted to a projecting end of the small-diameter shaft portion 14. The driving pulley 24 is rotatably supported by the driving casing 4 through a bearing 26.

The driving pulley 24 is rotated by a motive power from an engine of a vehicle, and the rotation of the driving pulley 24 can be transmitted to the driving shaft 10 through the electromagnetic clutch 22. Consequently, when the electromagnetic clutch 22 is turned ON while the engine is driven, the driving shaft 10 rotates together with the driving pulley 24.

On the other hand, a plurality of leg portions 27 for fixing the compressor to the vehicle room are formed in a low portion of an outer peripheral wall of the compression casing 6. The compression casing 6 has a head portion projecting horizontally on its upper portion of the outer peripheral wall. A suction port (not shown) and a discharge port 29 are formed so as to extend perfectly through the head portion. The suction port and the discharge port 29 are connected to an evaporator (not shown) and a condenser of the refrigeration circuit through a cooling medium pipeline (refer to FIG. 2).

A scroll unit 28 is accommodated as a compression unit in the compression casing 6. A suction chamber 31 communicating with the suction port is formed between the outer peripheral wall of the compression casing 6 and the scroll unit 28. The scroll unit 28 includes a movable scroll 30 and a fixed scroll 32. The movable scroll 30 and the fixed scroll 32 each are made of an aluminum alloy, and constituted by end plates (substrates) 34, and spiral walls (spiral laps) 36 which are formed integrally with the end plates 34.

As can be seen from FIG. 1, the movable scroll 30 and the fixed scroll 32 are disposed so that the end plates 34 face each other and the spiral walls 36 engage with each other. As a result, a compression chamber 38 is formed between both the spiral walls 36. A volume of such compression chamber 38 is increased or decreased in accordance with the relative gyrating motion of the movable scroll 30 with respect to the fixed scroll 32. Thus, a process for sucking the cooling medium into the compression chamber 38, and a process for compressing/discharging the cooling medium are performed.

In order to give the above-mentioned movable scroll 30 the gyrating motion, the end plate 34 of the movable scroll 30 is provided with a boss 40 projecting within the driving casing 4. The boss 40 is rotatably supported by an eccentric bushing 44 through a needle bearing 42. The eccentric bushing 44 is supported by a crank pin 46. The crank pin 46 projects from the large-diameter end portion 12 in a state of being decentered with respect to the center of the large-diameter end portion 12 of the driving shaft 10. Thus, when the driving shaft 10 rotates, the movable scroll 30 makes the gyrating motion through the crank pin 46 and the eccentric bushing 44.

In addition, a counter weight 48 for suppressing generation of vibrations following the turning of the movable scroll 30 is mounted to the eccentric bushing 44. Also, a rotation stopper 50 for the movable scroll 30 is provided between the driving casing 4 and the movable scroll 30. More specifically, the rotation stopper 50 is mounted between the large-diameter portion of the driving casing 4 and the end plate 34 of the movable scroll 30. The rotation stopper 50 includes a pair of ring plates 52 having annular ball races which are formed at equal intervals in its peripheral direction, and a plurality of balls 54 which are held between the annular ball races of the ring plates 52. The rotation stopper 50 blocks the rotation of the movable scroll 30 with the axis of the needle bearing 42 as the center.

On the other hand, the fixed scroll 32 is fixed within the compression casing 6 to the compression casing 6. A discharge chamber 56 is formed between the end plate 34 of the fixed scroll 32 and the inner wall of the compression casing 6. The discharge chamber 56 can communicate with the compression chamber 38 through a discharge hole 58 of the fixed scroll 32 and the discharge valve 60.

More specifically, the discharge hole 58 is formed so as to extend perfectly through the center of the end plate 34 of the fixed scroll 32, and opened and closed by the discharge valve 60. The discharge valve 60 includes a reed valve body 62 for opening/closing the discharge hole 58 on the discharge chamber 56 side and a stopper plate 64 for regulating the degree of opening of the reed valve body 62. Both the reed valve body 62 and the stopper plate 64 are attached to the end plate 34 of the fixed scroll 32 with attaching screws.

Then, in this compressor, a part of the discharge chamber 56 is partitioned to provide the separation chamber 66 and an oil storage chamber 68. The discharge chamber 56 which surrounds the discharge valve 60 communicates with the above-mentioned discharge port 29 through the separation chamber 66.

More specifically, the discharge chamber 56 is vertically partitioned by a partition wall 70 extending nearly vertically. The partition wall 70 forms an upper wall of the oil storage chamber 68. A communication path which extends from the oil storage chamber 68 to the movable scroll 30 side is formed in the fixed scroll 32. The communication path is provided with a filter 72 and an orifice 74. Consequently, the lubricating oil stored in the oil storage chamber 68 is supplied to the movable scroll 30 side through the orifice 74.

A cylindrical peripheral wall 78 which is formed integrally with an end wall 76 of the compression casing 6 extends upward from the upper surface of the partition wall 70. An upper end of the peripheral wall 78 communicates with an outer peripheral wall of the compression casing 6.

An insertion hole 82 which opens outward through the outer peripheral wall of the compression casing 6 and communicates with the separation chamber 66 is formed coaxially with the separation chamber 66 and above the separation chamber 66. The insertion hole 82 is closed by screwing thereto a seal bolt 84. The seal bolt 84 includes a head portion 84*a* for engaging with a tool when being screwed into the insertion hole 82, and an axis portion 84*b* in which a thread ridge to be screwed into the insertion hole 82 is formed. In an end portion of the axis portion 84*b*, the separation tube 80 is formed integrally with the axis portion 84*b* so that when the seal bolt 84 is in a state of being screwed into the insertion hole 82, the separation tube 80 is disposed within the separation chamber 66. In such a manner, the separation tube 80 disposed within the separation chamber 66 and the separation chamber 66 constitute an oil separator.

Figure 2:
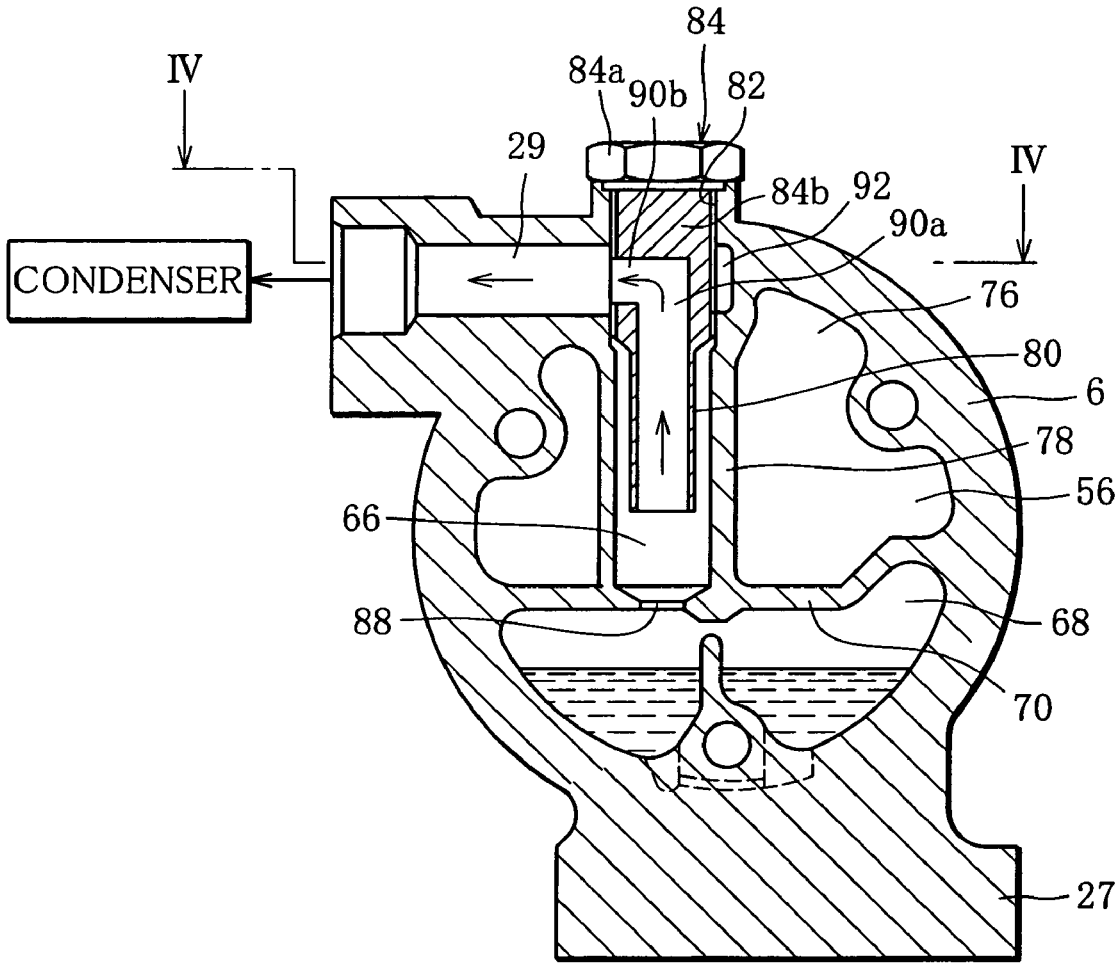
FIG. 2 is a cross sectional view taken along the line II-II of FIG. 1.
Figure 3:
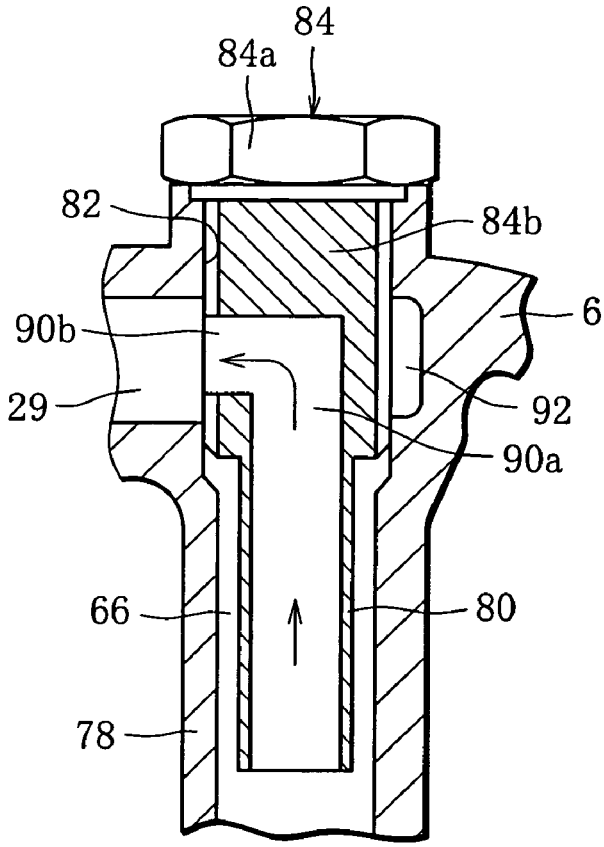
FIG. 3 is an enlarged view of a seal bolt circumference shown in FIG. 2.

In addition, a flow path 90 which communicates with the inside of the separation tube 80 is formed within the axis portion 84*b* of the seal bolt 84. FIG. 2 is a cross sectional view taken along the line II-II of FIG. 1, and FIG. 3 is an enlarged view of a seal bolt 84 circumference of FIG. 2. As shown in FIGS. 2 and 3, the flow path 90 includes a first flow path 90*a* parallel with a center axis of the axis portion 84*b*, and a second flow path 90*b* which communicates with the first flow path 90*a* and which opens to the side of the seal bolt 84 in an outer peripheral surface of the axis portion 84*b*.

An annular chamber 92 is formed in the compression casing 6 so that when the seal bolt 84 is screwed into the insertion hole 82 to close the insertion hole 82, the outer periphery of the axis portion 84 including the opening portion of the second flow path 90*b* is surrounded by the annular chamber 92. The annular chamber 92 communicates with the discharge port 29.

Figure 4:
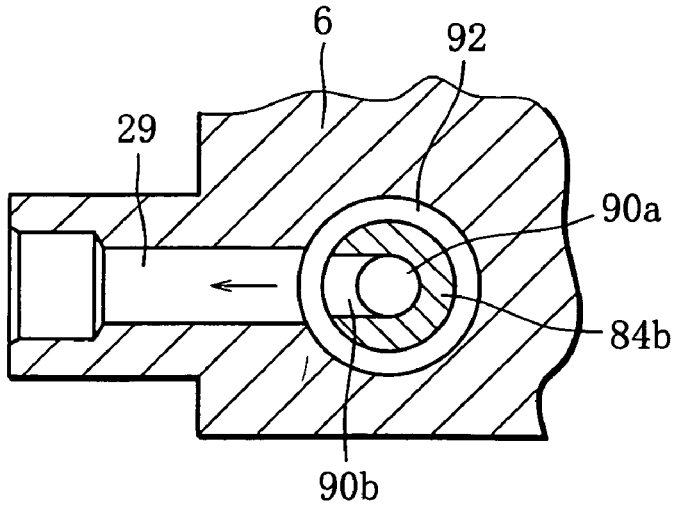
FIG. 4 is a cross sectional view taken along the line IV-IV of FIG. 2.

FIG. 4 shows a seal bolt 84 circumference in a cross section taken along the line IV-IV of FIG. 2. As shown in FIG. 4, the annular chamber 92 surrounds the whole circumference of the axis portion 84*b* of the seal bolt 84. For this reason, even in the case where when the seal bolt 84 is fastened, the opening of the second flow path 90*b* in the outer peripheral surface of the axis portion 84*b* is not directed toward the discharge port 29, the communication between the flow path 90 and the discharge port 29 is ensured.

In addition, as shown in FIG. 3, the axis portion 84*b* of the seal bolt 84 is screwed into the insertion hole 82 up to a position below the annular chamber 92. Hence, the separation chamber 66 is prevented from directly communicating with the discharge port 29 and the annular chamber 92 through the insertion hole 82.

Thus, when the seal bolt 84 is screwed into the insertion hole 82, the insertion hole 82 is closed by the seal bolt 84. Also, the separation chamber 66 communicates with the discharge port 29 through the inside of the separation tube 80, the flow path 90 within the seal bolt 84 and the annular chamber 92 of the compression casing 6.

The upper portion of the separation chamber 66 communicates with the discharge chamber 56 through two introduction holes 86 bored through the peripheral wall 78. The two introduction holes 86 extend in a direction of a tangential line of the inner peripheral surface of the peripheral wall 78 for an annular space defined between the outer peripheral surface of the separation tube 80 and the inner peripheral surface of the peripheral wall 78. In addition, the separation chamber 66 communicates with the oil storage chamber 68 through a through hole 88 bored through the partition wall 70.

According to the scroll type compressor described above, the movable scroll 30 makes the gyrating motion in accordance with the rotation of the driving shaft 10. During the gyrating motion, the rotation of the movable scroll 30 is in a state of being blocked by the rotation stopper 50. The gyrating motion of the movable scroll 30 periodically moves the compression chamber 38 in a direction of being moved into and away from contact with the discharge hole 58. In accordance with the periodic movement, the volume of the compression chamber 38 is increased or decreased.

As a result, the cooling medium is sucked from the suction chamber 31 into the compression chamber 38. Then, the cooling medium sucked is compressed in a process in which the compression chamber 38 moves toward the discharge hole 58 to decrease its volume. When the compression chamber 38 reaches the discharge hole 58, pressure of the cooling medium within the compression chamber 38 overcomes a shutoff pressure of the discharge valve 60 to open the discharge valve 60. Thus, the compressed cooling medium is discharged from the compression chamber 38 into the discharge chamber 56 through the discharge hole 58.

Then, the compressed cooling medium flows from the discharge chamber 56 into the separation chamber 66 through the introduction hole 86. The compressed cooling medium which has flowed into the separation chamber 66 flows downward while revolving helically in an annular space within the separation chamber 66 along the outer peripheral surface of the separation tube 80 and the inner peripheral surface of the cylindrical peripheral wall 78. In this process, after the mist-like lubricating oil contained in the cooling medium has been centrifuged to be stuck to the inner peripheral surface of the peripheral wall 78, it drops due to its dead weight to flow into the oil storage chamber 68 through the through hole 88.

The compressed cooling medium from which the lubricating oil has been separated flows from a lower end of the separation tube 80 into the separation tube 80 to rise through the inside of the separation tube 80. Then, the compressed cooling medium flows into the flow path 90 within the axis portion 84*b* of the seal bolt 84. The second flow path 90*b* of the flow path 90 opens to the side of the seal bolt 84 in the outer peripheral surface of the axis portion 84*b*, and communicates with the annular chamber 92 of the compression casing 6. Thus, after having passed through the first flow path 90*a*, the compressed cooling medium within the flow path 90 reaches the annular chamber 92 through the second flow path 90*b*. Moreover, the compressed cooling medium is supplied from the annular chamber 92 to the condenser of the refrigeration circuit through the discharge port 29.

In the manner described above, when the cooling medium is compressed and the compressed cooling medium is supplied to the condenser of the refrigeration circuit, a part of the lubricating oil contained in the compressed cooling medium is separated, and thus the reduction in cooling ability due to an excessive amount of lubricating oil is prevented.

As described above, the separation tube 80 which constitutes together with the separation chamber 66 the oil separator is formed integrally with the seal bolt 84. Thus, after the separation tube 80 has been inserted into the separation chamber 66 through the insertion hole 82 bored through the compression casing 6, the seal bolt 84 is screwed into the insertion hole 82, whereby the disposition and fixing of the separation tube 80 to the separation chamber 66, and the closing of the insertion hole 82 can be collectively performed. Consequently, not only the assembly process is simplified, but also it is unnecessary to specially prepare the member for fixing the separation tube 80. As a result, it is possible to suppress an increase in part cost and assembly cost due to the provision of the oil separator in the compressor.

In addition, after the compressed cooling medium from which a part of the lubricating oil has been separated in the separation chamber 66 passes from the inside of the separation tube 80 through the flow path 90 within the axis portion 84*b* of the seal bolt 84 to be temporarily introduced into the annular chamber 92 of the compression casing 6, it is supplied to the discharge port 29. Thus, it is unnecessary to dispose the discharge port 29 and the separation tube 80 coaxially with each other. For this reason, in the case of this compressor, it is possible to freely select the relative disposition of the discharge port 29 with respect to the separation tube 80. As a result, the position and direction of the discharge port 29 in the compressor can be determined in correspondence to the layout within the vehicle room.

It should be noted that the present invention is not limited to the above-mentioned embodiment, and thus various kinds of modifications and changes may be made.

For example, while the second flow path 90*b* formed in the axis portion 84*b* of the seal bolt 84, as shown in FIGS. 3 and 4, opens only in one direction in the outer peripheral surface of the axis portion 84*b*, it may also open in two directions including the opposite direction. In addition, at this time, even when the annular chamber 92 may be formed in a C-like shape over a half-circumference or a half or more circumference range instead of being formed over the whole circumference of the axis portion 84*b* as shown in FIG. 4, the communication between the flow path 90 and the annular chamber 92 can be ensured irrespective of the direction of the second flow path 90*b* when the seal bolt 84 is fastened.

In addition, while the annular chamber 92 is formed in the compression casing 6, it may also be formed on the axis portion 84*b* side of the seal bolt 84. That is, a construction may also be adopted such that an annular groove is formed in the outer peripheral surface of the axis portion 84*b* so as to pass across the opening of the second flow path 90*b* in the axis portion 84*b*, and in a state in which the seal bolt 84 is screwed into the insertion hole 82, the annular groove communicates with the discharge port 29.

Finally, the compressor of the present invention is not limited to one which is used in the refrigeration circuit of the air conditioner for a vehicle as in the above-mentioned embodiment. Thus, any other suitable one can offer the same effects as those of the above-mentioned embodiment as long as it is used to compress the working fluid containing the lubricating oil. In addition, the type of the compressor is not limited to the scroll type compressor, and thus a swash plate type compressor or a vane type compressor may also be adopted.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A compressor, comprising:

a compression unit disposed within a housing for compressing a working fluid containing a lubricating oil; and an oil separator for feeding the working fluid toward a discharge port provided in the housing after separating a part of the lubricating oil from the working fluid compressed by the compression unit, the oil separator having a cylindrical separation chamber into which the working fluid is introduced, and a separation tube provided within the separation chamber for introducing the working fluid introduced into the separation chamber toward the discharge port through its inside;

wherein an insertion hole through which the separation tube is inserted into the separation chamber is formed in the housing separately from the discharge port, and the insertion hole is closed by a seal bolt screwed into the insertion hole;

wherein the seal bolt and the separation tube are formed integrally with each other, and when the insertion hole is closed by the seal bolt, a flow path through which the separation tube and the discharge port communicate with each other is formed in the seal bolt, wherein the seal bolt includes a head portion and an axis portion in which a screw ridge to be screwed into the insertion hole is formed, the separation tube has a center axis in common to the seal bolt and is extendedly provided integrally with an end portion of the axis portion of the seal bolt, and the flow path includes a first flow path which communicates with the inside of the separation tube and which is formed within the axis portion in parallel with the center axis of the seal bolt, and a second flow path which communicates with the first flow path, opens to the side of the seal bolt in an outer peripheral surface of the axis portion, and communicates with the discharge port when the seal bolt is screwed into the insertion hole, wherein an annular chamber is formed in an inner wall of the housing through which the insertion hole is formed along the outer peripheral surface of the axis portion so that an opening of the second flow path is located in a position for communication with the annual chamber when the seal bolt is screwed into the insertion hole, and the annular chamber communicates with the discharge port.

* * * * *